US008177693B2

(12) United States Patent
Webber et al.

(10) Patent No.: US 8,177,693 B2
(45) Date of Patent: May 15, 2012

(54) CALF EXERCISE MACHINE WITH ROCKING USER SUPPORT

(75) Inventors: Randall T. Webber, La Jolla, CA (US); Bruce Hockridge, San Diego, CA (US); Jeffrey O. Meredith, San Diego, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 0 days.

(21) Appl. No.: 13/029,964

(22) Filed: Feb. 17, 2011

(65) Prior Publication Data

US 2011/0207584 A1 Aug. 25, 2011

Related U.S. Application Data

(60) Provisional application No. 61/307,986, filed on Feb. 25, 2010.

(51) Int. Cl.
*A63B 21/04* (2006.01)

(52) U.S. Cl. ..... 482/97; 482/93; 482/136

(58) Field of Classification Search ..... 482/92–103, 482/133–139

See application file for complete search history.

(56) References Cited

U.S. PATENT DOCUMENTS

| | | | |
|---|---|---|---|
| 248,121 | A | 10/1881 | Tuttle |
| 2,145,940 | A | 2/1939 | Marlowe |
| 2,252,156 | A | 8/1941 | Bell |
| 3,116,062 | A | 12/1963 | Zinkin |
| 3,446,503 | A | 5/1969 | Lawton |
| 3,592,465 | A | 7/1971 | Fulkerson, Jr. |
| 3,640,528 | A | 2/1972 | Proctor |
| 3,707,285 | A | 12/1972 | Martin |
| 3,917,262 | A | 11/1975 | Salkeld |
| 4,004,801 | A | 1/1977 | Campanero et al. |
| 4,111,414 | A | 9/1978 | Roberts |
| 4,149,714 | A | 4/1979 | Lambert, Jr. |
| 4,231,568 | A | 11/1980 | Riley et al. |
| 4,300,760 | A | 11/1981 | Bobroff |
| 4,336,934 | A | 6/1982 | Hanagan et al. |
| 4,390,179 | A | 6/1983 | Szkalak |
| 4,441,708 | A | 4/1984 | Brentham |

(Continued)

FOREIGN PATENT DOCUMENTS

| | | |
|---|---|---|
| CA | 2075331 | 2/1994 |

(Continued)

OTHER PUBLICATIONS

08003 Rower, Gym 80 Brochure, 2001, 1 page.

(Continued)

*Primary Examiner* — Loan Thanh
*Assistant Examiner* — Daniel F Roland
(74) *Attorney, Agent, or Firm* — Procopio, Cory, Hargreaves & Savitch LLP

(57) ABSTRACT

A calf exercise machine has a floor engaging main frame, a user support pivot, a user support assembly pivotally mounted on the main frame via the user support pivot, and a pivotally mounted user engagement device. A user engaging foot plate assembly is pivotally mounted to track movement of the user's feet during a calf exercise, and may comprise either the user support in a standing calf machine or the user engagement device in a seated calf machine. A connecting link translates movement of the user engagement device to movement of the user support so that pivotal movement in the user engagement device results in a self-aligning, pivoting movement of the user support.

30 Claims, 13 Drawing Sheets

U.S. PATENT DOCUMENTS

| | | | | |
|---|---|---|---|---|
| 4,448,412 | A | 5/1984 | Brentham | |
| 4,468,025 | A | 8/1984 | Sferle | |
| 4,478,411 | A | 10/1984 | Baldwin | |
| 4,511,137 | A | 4/1985 | Jones | |
| 4,577,861 | A | 3/1986 | Bangerter et al. | |
| 4,598,907 | A | 7/1986 | Ross | |
| 4,632,390 | A | 12/1986 | Richey | |
| 4,641,833 | A | 2/1987 | Trethewey | |
| 4,678,185 | A | 7/1987 | Mahnke | |
| 4,684,126 | A | 8/1987 | Dalebout et al. | |
| 4,700,946 | A | 10/1987 | Breunig | |
| 4,743,010 | A * | 5/1988 | Geraci | 482/72 |
| 4,790,530 | A | 12/1988 | Maag | |
| 4,793,608 | A | 12/1988 | Mahnke et al. | |
| 4,822,038 | A | 4/1989 | Maag | |
| D301,597 | S | 6/1989 | Lehtonen | |
| 4,844,456 | A | 7/1989 | Habing et al. | |
| 4,858,915 | A | 8/1989 | Szabo | |
| D303,558 | S | 9/1989 | Alessandri | |
| 4,883,270 | A * | 11/1989 | Maag | 482/97 |
| 4,911,438 | A | 3/1990 | Van Straaten | |
| 4,915,377 | A | 4/1990 | Mahnke et al. | |
| 4,917,379 | A | 4/1990 | Maag | |
| 4,943,051 | A | 7/1990 | Haskins et al. | |
| 4,949,951 | A | 8/1990 | Deola | |
| 4,949,958 | A | 8/1990 | Richey | |
| 5,011,139 | A | 4/1991 | Towley | |
| 5,050,873 | A | 9/1991 | Jones | |
| 5,066,003 | A | 11/1991 | Jones | |
| 5,066,004 | A | 11/1991 | Jones | |
| 5,100,128 | A | 3/1992 | Mabry | |
| 5,106,081 | A | 4/1992 | Webb | |
| 5,108,095 | A | 4/1992 | Nichols | |
| 5,217,422 | A | 6/1993 | Domzalski | |
| 5,221,245 | A | 6/1993 | Yeh | |
| 5,236,406 | A | 8/1993 | Webber | |
| 5,250,013 | A | 10/1993 | Brangi | |
| 5,254,067 | A | 10/1993 | Habing et al. | |
| 5,263,914 | A | 11/1993 | Simonson et al. | |
| 5,267,930 | A | 12/1993 | Henes | |
| 5,299,997 | A | 4/1994 | Chen | |
| 5,304,107 | A | 4/1994 | Jones | |
| 5,322,489 | A | 6/1994 | Webb et al. | |
| 5,330,404 | A | 7/1994 | Lopeteguy et al. | |
| 5,330,405 | A | 7/1994 | Habing et al. | |
| 5,334,120 | A | 8/1994 | Rasmussen | |
| 5,342,269 | A | 8/1994 | Huang et al. | |
| 5,342,270 | A | 8/1994 | Jones | |
| 5,346,447 | A | 9/1994 | Stearns | |
| 5,352,171 | A | 10/1994 | Lin | |
| 5,354,248 | A | 10/1994 | Rawls et al. | |
| 5,356,357 | A | 10/1994 | Wang et al. | |
| 5,356,358 | A | 10/1994 | Chen | |
| 5,366,432 | A | 11/1994 | Habing et al. | |
| 5,387,171 | A | 2/1995 | Casey et al. | |
| 5,401,227 | A | 3/1995 | Webber | |
| D357,041 | S | 4/1995 | McBride et al. | |
| 5,409,440 | A | 4/1995 | Yang | |
| 5,417,633 | A | 5/1995 | Habing | |
| 5,417,634 | A | 5/1995 | Habing | |
| 5,419,751 | A | 5/1995 | Byrd et al. | |
| 5,421,796 | A | 6/1995 | Jones et al. | |
| 5,437,589 | A | 8/1995 | Habing | |
| 5,447,480 | A | 9/1995 | Fulks | |
| 5,453,066 | A | 9/1995 | Richter, Jr. | |
| 5,458,553 | A | 10/1995 | Wu | |
| 5,478,298 | A | 12/1995 | Chen | |
| 5,484,365 | A | 1/1996 | Jones et al. | |
| 5,486,150 | A | 1/1996 | Randolph | |
| 5,498,222 | A | 3/1996 | Hur | |
| 5,499,959 | A | 3/1996 | Holmes et al. | |
| 5,503,608 | A | 4/1996 | Chang | |
| 5,505,679 | A | 4/1996 | McBride et al. | |
| 5,507,710 | A | 4/1996 | Chen | |
| 5,518,477 | A | 5/1996 | Simonson | |
| 5,520,599 | A | 5/1996 | Chen | |
| 5,527,243 | A | 6/1996 | Chen | |
| 5,527,249 | A | 6/1996 | Harris | |
| 5,527,250 | A | 6/1996 | Chen | |
| 5,533,953 | A | 7/1996 | Lui et al. | |
| 5,540,639 | A | 7/1996 | Potts et al. | |
| D372,509 | S | 8/1996 | Yang | |
| 5,547,443 | A | 8/1996 | Chen | |
| 5,547,444 | A | 8/1996 | Huang et al. | |
| 5,549,530 | A | 8/1996 | Fulks | |
| 5,549,533 | A | 8/1996 | Olson et al. | |
| 5,554,086 | A | 9/1996 | Habing et al. | |
| 5,554,090 | A * | 9/1996 | Jones | 482/97 |
| 5,562,577 | A | 10/1996 | Nichols et al. | |
| 5,573,482 | A | 11/1996 | Wang et al. | |
| 5,580,340 | A | 12/1996 | Yu | |
| 5,580,341 | A | 12/1996 | Simonson | |
| 5,582,563 | A | 12/1996 | Fan | |
| 5,597,375 | A | 1/1997 | Simonson | |
| 5,603,678 | A | 2/1997 | Wilson | |
| 5,616,105 | A | 4/1997 | Wang et al. | |
| 5,616,107 | A * | 4/1997 | Simonson | 482/97 |
| 5,620,402 | A | 4/1997 | Simonson | |
| 5,626,542 | A | 5/1997 | Dalebout et al. | |
| 5,628,715 | A | 5/1997 | Simonson | |
| 5,643,147 | A | 7/1997 | Huang | |
| 5,643,152 | A | 7/1997 | Simonson | |
| 5,653,667 | A * | 8/1997 | Reyes | 482/121 |
| 5,658,227 | A | 8/1997 | Stearns | |
| D383,814 | S | 9/1997 | Ward | |
| D384,118 | S | 9/1997 | Deblauw | |
| 5,669,865 | A | 9/1997 | Gordon | |
| 5,672,142 | A | 9/1997 | Wu | |
| 5,674,161 | A | 10/1997 | Lin | |
| 5,676,626 | A | 10/1997 | Huang | |
| 5,681,247 | A | 10/1997 | Webber | |
| 5,683,334 | A | 11/1997 | Webber | |
| 5,690,593 | A | 11/1997 | Huang | |
| 5,695,434 | A | 12/1997 | Dalebout et al. | |
| 5,695,435 | A | 12/1997 | Dalebout et al. | |
| 5,702,328 | A | 12/1997 | Mansvelt | |
| 5,711,749 | A | 1/1998 | Miller | |
| 5,720,695 | A | 2/1998 | Eckmann | |
| 5,722,918 | A | 3/1998 | Lee | |
| 5,733,229 | A | 3/1998 | Dalebout et al. | |
| 5,733,232 | A | 3/1998 | Hsu | |
| 5,749,813 | A | 5/1998 | Domzalski | |
| 5,762,590 | A * | 6/1998 | St. Fleur et al. | 482/97 |
| 5,800,321 | A | 9/1998 | Webber | |
| 5,803,882 | A | 9/1998 | Habing et al. | |
| 5,810,698 | A | 9/1998 | Hullett et al. | |
| 5,810,701 | A | 9/1998 | Ellis et al. | |
| 5,827,158 | A | 10/1998 | Drecksel | |
| 5,876,095 | A | 3/1999 | Johnston | |
| 5,885,193 | A | 3/1999 | Habing et al. | |
| 5,897,467 | A | 4/1999 | Habing et al. | |
| 5,897,473 | A | 4/1999 | Koenig | |
| 5,899,836 | A | 5/1999 | Chen | |
| 5,906,564 | A | 5/1999 | Jacobsen | |
| 5,916,072 | A | 6/1999 | Webber | |
| 5,938,570 | A | 8/1999 | Maresh | |
| 5,938,571 | A | 8/1999 | Stevens | |
| 5,944,641 | A | 8/1999 | Habing | |
| 5,961,427 | A | 10/1999 | Habing et al. | |
| 5,961,428 | A | 10/1999 | Webber | |
| 5,967,954 | A | 10/1999 | Habing | |
| 5,971,895 | A | 10/1999 | Habing | |
| 5,971,901 | A | 10/1999 | Shaw | |
| 5,989,165 | A | 11/1999 | Giannelli et al. | |
| 5,997,446 | A | 12/1999 | Stearns | |
| 5,997,447 | A | 12/1999 | Giannelli et al. | |
| 6,004,247 | A | 12/1999 | Webber | |
| 6,024,677 | A | 2/2000 | Siwertz | |
| 6,030,322 | A | 2/2000 | Webber | |
| 6,056,675 | A | 5/2000 | Aruin et al. | |
| 6,056,678 | A | 5/2000 | Giannelli | |
| 6,071,216 | A | 6/2000 | Giannelli et al. | |
| 6,074,328 | A | 6/2000 | Johnson | |
| 6,080,091 | A | 6/2000 | Habing et al. | |
| 6,086,521 | A | 7/2000 | Solland | |
| 6,090,020 | A | 7/2000 | Webber | |
| 6,120,419 | A | 9/2000 | Huang | |

| | | | | |
|---|---|---|---|---|
| 6,135,930 | A | 10/2000 | Kuo | |
| 6,142,914 | A | 11/2000 | Crawford et al. | |
| 6,142,917 | A | 11/2000 | Giannelli et al. | |
| 6,152,864 | A | 11/2000 | Giannelli et al. | |
| 6,162,153 | A | 12/2000 | Perez et al. | |
| 6,171,219 | B1 | 1/2001 | Simonson | |
| 6,220,993 | B1 | 4/2001 | Sencil | |
| 6,244,995 | B1 | 6/2001 | Prsala | |
| 6,244,996 | B1 | 6/2001 | Sencil | |
| 6,251,047 | B1 | 6/2001 | Stearns et al. | |
| 6,254,516 | B1 | 7/2001 | Giannelli et al. | |
| 6,264,588 | B1 | 7/2001 | Ellis | |
| 6,287,241 | B1 | 9/2001 | Ellis | |
| 6,302,832 | B1 | 10/2001 | Stearns | |
| 6,302,833 | B1 | 10/2001 | Ellis et al. | |
| 6,312,365 | B1 * | 11/2001 | Koenig | 482/97 |
| 6,312,366 | B1 | 11/2001 | Prusick | |
| 6,319,178 | B1 | 11/2001 | Webber | |
| 6,340,342 | B1 | 1/2002 | Lee | |
| 6,350,219 | B1 | 2/2002 | Hobson | |
| 6,387,020 | B1 | 5/2002 | Simonson | |
| 6,394,937 | B1 | 5/2002 | Voris | |
| 6,398,699 | B1 * | 6/2002 | Yang | 482/142 |
| 6,491,609 | B2 | 12/2002 | Webber | |
| 6,517,468 | B1 | 2/2003 | Lepcevic | |
| 6,533,710 | B2 * | 3/2003 | Lin et al. | 482/123 |
| 6,561,960 | B2 | 5/2003 | Webber | |
| 6,579,213 | B1 | 6/2003 | Webber et al. | |
| 6,605,022 | B2 | 8/2003 | Webber | |
| 6,605,024 | B2 * | 8/2003 | Stearns | 482/142 |
| D481,428 | S | 10/2003 | Giannelli et al. | |
| 6,659,919 | B2 | 12/2003 | Deola | |
| 6,676,577 | B2 | 1/2004 | Stearns | |
| D490,128 | S | 5/2004 | Giannelli et al. | |
| 6,743,158 | B2 | 6/2004 | Giannelli et al. | |
| 6,752,745 | B1 * | 6/2004 | Davis | 482/72 |
| 6,752,748 | B1 | 6/2004 | Scotti | |
| 6,770,017 | B1 | 8/2004 | Leipheimer | |
| 6,811,522 | B1 | 11/2004 | McQuinn | |
| 6,855,098 | B2 | 2/2005 | Reitz et al. | |
| 6,913,565 | B2 | 7/2005 | Mitchell et al. | |
| 6,916,278 | B2 | 7/2005 | Webber | |
| 6,966,872 | B2 | 11/2005 | Eschenbach | |
| 6,971,978 | B2 | 12/2005 | Hyder | |
| 6,988,977 | B2 | 1/2006 | Webber et al. | |
| 7,052,444 | B2 | 5/2006 | Webber | |
| 7,052,446 | B2 | 5/2006 | Morris et al. | |
| 7,070,545 | B2 | 7/2006 | Lull et al. | |
| 7,108,641 | B2 | 9/2006 | Pertegaz-Esteban | |
| 7,141,003 | B2 | 11/2006 | Wu | |
| 7,141,008 | B2 | 11/2006 | Krull et al. | |
| 7,166,066 | B2 | 1/2007 | Webber | |
| 7,220,221 | B2 | 5/2007 | Mosimann et al. | |
| 7,223,213 | B2 | 5/2007 | Golesh | |
| 7,229,389 | B2 | 6/2007 | Hong | |
| 7,322,906 | B2 | 1/2008 | Webber | |
| 7,331,911 | B2 | 2/2008 | Webber et al. | |
| 7,335,140 | B2 | 2/2008 | Webber et al. | |
| 7,357,759 | B2 * | 4/2008 | Bonnell | 482/72 |
| 7,357,761 | B2 | 4/2008 | Mattox | |
| 7,357,768 | B2 | 4/2008 | Marshall | |
| 7,361,125 | B2 | 4/2008 | Webber et al. | |
| 7,384,381 | B2 | 6/2008 | Webber et al. | |
| 7,468,024 | B2 | 12/2008 | Webber et al. | |
| 7,549,949 | B2 | 6/2009 | Webber et al. | |
| 7,553,263 | B2 * | 6/2009 | Webb et al. | 482/100 |
| 7,563,209 | B2 | 7/2009 | Webber et al. | |
| 7,594,880 | B2 * | 9/2009 | Webber et al. | 482/96 |
| 7,601,187 | B2 | 10/2009 | Webber et al. | |
| 7,654,938 | B2 | 2/2010 | Webber et al. | |
| 7,654,940 | B2 | 2/2010 | Webber et al. | |
| 7,670,269 | B2 | 3/2010 | Webber et al. | |
| 7,717,832 | B2 | 5/2010 | Webber et al. | |
| 7,731,638 | B2 | 6/2010 | Webber et al. | |
| 7,766,802 | B2 | 8/2010 | Webber et al. | |
| 7,794,371 | B2 | 9/2010 | Webber et al. | |
| 7,794,372 | B1 | 9/2010 | Webber et al. | |
| 7,878,953 | B2 | 2/2011 | Webber et al. | |
| 7,938,760 | B1 * | 5/2011 | Webber et al. | 482/97 |
| 8,002,679 | B2 * | 8/2011 | Webber et al. | 482/96 |
| 2002/0013199 | A1 | 1/2002 | Giannelli et al. | |
| 2002/0103058 | A1 | 8/2002 | Webber | |
| 2002/0183173 | A1 | 12/2002 | Abelbeck et al. | |
| 2002/0187879 | A1 | 12/2002 | Ball et al. | |
| 2003/0199362 | A1 | 10/2003 | Chamberlin | |
| 2004/0005966 | A1 | 1/2004 | Chen | |
| 2004/0229734 | A1 * | 11/2004 | Stearns | 482/93 |
| 2005/0032611 | A1 * | 2/2005 | Webber et al. | 482/72 |
| 2005/0096196 | A1 | 5/2005 | Webber et al. | |
| 2005/0096197 | A1 | 5/2005 | Webber et al. | |
| 2005/0096198 | A1 | 5/2005 | Webber et al. | |
| 2006/0116253 | A1 | 6/2006 | Nizam | |
| 2006/0148625 | A1 | 7/2006 | Garner | |
| 2006/0211549 | A1 | 9/2006 | Nohejl | |
| 2006/0247107 | A1 | 11/2006 | Carter | |
| 2006/0276313 | A1 | 12/2006 | Hong | |
| 2007/0037673 | A1 | 2/2007 | Giannelli et al. | |
| 2007/0232462 | A1 | 10/2007 | Webber et al. | |
| 2007/0232467 | A1 | 10/2007 | Puzey | |
| 2007/0270290 | A1 * | 11/2007 | Mosimann et al. | 482/100 |
| 2007/0293377 | A1 | 12/2007 | Webber et al. | |
| 2007/0293378 | A1 | 12/2007 | Webber et al. | |
| 2008/0058176 | A1 | 3/2008 | Webber et al. | |
| 2008/0058181 | A1 | 3/2008 | Webber et al. | |
| 2008/0132389 | A1 | 6/2008 | Webber et al. | |
| 2008/0153677 | A1 | 6/2008 | Webber | |
| 2008/0182732 | A1 | 7/2008 | Webber et al. | |
| 2008/0214365 | A1 | 9/2008 | Webber et al. | |
| 2008/0214367 | A1 | 9/2008 | Webber et al. | |
| 2008/0220950 | A1 | 9/2008 | Webber et al. | |
| 2008/0234110 | A1 | 9/2008 | Webber et al. | |
| 2008/0242517 | A1 | 10/2008 | Webber et al. | |
| 2008/0248929 | A1 | 10/2008 | Webber et al. | |
| 2011/0152047 | A1 * | 6/2011 | Bedard et al. | 482/142 |
| 2011/0207584 | A1 * | 8/2011 | Webber et al. | 482/94 |

FOREIGN PATENT DOCUMENTS

| | | |
|---|---|---|
| GB | 2162075 | 1/1986 |
| SU | 1674874 | 9/1991 |

OTHER PUBLICATIONS

Bicep Curl PL-2300 and Tricep Extension PL-2200, Paramount Brochure, 1997, 1 page.
Body Masters brochure, 2002, 1 page.
Boss Fitness Brochure, 1993, 1 page.
CD 2400 Leg Extension/Leg Curl, Hoist Fitness Systems, Owner's Catalog, 2005, 1 page.
Chest Press and Incline Press, plate-loaded, Cybex Brochure, 1996, 1 page.
FA-508 Dip Machine, Flex Brochure, (date unknown), is admitted prior art for this application, 1 page.
Flex Fitness Brochure, (date unknown), is admitted prior art for this application, 1 page.
Flex FL-109 Standing Calf, 2002, p. 9 of product brochure.
Flex FL-115 45 Donkey Calf, 2002, 1 page.
Flex Product Sheet, (date unknown), is admitted prior art for this application, 1 page.
FreeMotion Calf, (date unknown), is admitted prior art for this application, 1 page.
FS-403 Shoulder Press, Flex Brochure, 1995, 1 page.
Gravity Gym Instruction Manual, Seated Bench Press, (date unknown), is admitted prior art for this application, 1 page.
Gym 80 brochure, 2001, 1 page.
Hammer Strength, Hammer Brochure, 1993, 1 page.
Hoist brochure, 1993 Hoist HLP brochure, 1998, 1 page.
Hoist CL2415, CL2203 and CL2601 product brochure, 2000, 2 page.
Hoist Diamond Gym Brochure, Hoist Fitness Systems, 1993, 1 page.
Hoist Prime 8 Brochure, Hoist Fitness Systems, 2000, 1 page.
Hoist Selectionized Duals HD Series, HoisT Brochure, 2002, 1 page.
How It Works Flyer, illustration of exercised performed on U.S. Patent No. 5,527,249 of Harris, (date unknown), is admitted prior art for this application, 1 page.
Keiser brochure, 1999, 1 page.

Leg Press Machine, Schwinn Natural Strength, European trade magazine, (date unknown), is admitted prior art for this application, 1 page.
Leg Press, Cybex International Brochure, 2002, 1 page.
Leverage Gym Brochure, Home Gym Warehouse, 2000, 1 page.
Low Back Machine, Hoist Brochure, HS1225, 2005, 1 page.
Models 217 and 206-2, Polaris Brochure, (date unknown), is admitted prior art for this application, 1 page.
Pace, 318 Dip/Shrug, Hanley International Brochure, (date unknown), is admitted prior art for this application, 1 page.
Paramount Advanced Performance System—Legg Press AP—2800 (brochure dated 2000), 1 page.
Paramount Calf Raise AP-3500, 2001, 1 page.
Paramount plate loaded unit, 2002, 1 page.
Paramount selectorized unit, 2000, 1 page.
U.S. Appl. No. 12/253,392, filed Oct. 17, 2008, Webber et al.
U.S. Appl. No. 12/327,692, filed Dec. 30, 2008, Webber et al.
Schwinn Natural Strength, Schwinn magazine Ad, (date unknown), is admitted prior art for this application.
Seated Calf and Standing Calf/Squat, Polaris by Iron Co., 1986, 1 page.
Seated Close Grip Bench Press, Gravity Gym Instruction Manual, (date unknown), is admitted prior art for this application, 1 page.
Sprint by Hogan Industries, (date unknown), is admitted prior art for this application, 1 page.
Sprint by Hogan Industries, Linear Motion Chest Press, (date unknown), is admitted prior art for this application, 1 page.
Sprint Circuit, Hogan Industries Brochure, (date unknown), is admitted prior art for this application, 1 page.
Tuff Stuff brochure, (date unknown), is admitted prior art for this application, 1 page.
Vertical Bench Press Machine, Hoist Brochure, 1993, 1 page.

* cited by examiner

CALF EXERCISE MACHINE WITH ROCKING USER SUPPORT

RELATED APPLICATION

The present application claims the benefit of co-pending U.S. provisional patent application No. 61/307,986 filed Feb. 25, 2010, which is incorporated herein by reference in its entirety.

BACKGROUND

1. Field of the Invention

This invention relates generally to exercise machines, and is particularly concerned with a calf exercise machine.

2. Related Art

In order to perform a calf exercise, the foot is rotated to move between a horizontal position into a tip toe position and back to a horizontal position, thereby contracting and extending the calf muscles. In a standing calf exercise machine, this movement is duplicated while the exerciser stands on a foot plate and pushes up on shoulder pads which are linked to an exercise resistance. In a seated calf exercise machine, the user performs the same exercise in a seated position, with their feet engaging a foot plate and rotating the plate against an exercise resistance as they move their feet between a flat position and an extended position.

In current calf exercise machines, either the user engaging device moves while the user support remains stationary, or the user support moves while the user engaging device is stationary. In a seated calf machine, the user may sit on a stationary seat with their legs extended and engaging a rotating foot plate. In other known seated calf machines, such as the machine described in U.S. Pat. No. 5,554,090 of Jones, the user sits on a movably mounted seat and engages a stationary foot plate, pushing against the foot plate in a toe extension movement so as to rotate the seat. This can result in poor alignment of the body and legs with the feet and strain on the toes. For example, in some known seated calf machines, the user starts the exercise with their legs extended horizontally and their knees slightly bent while engaging the foot plate with the feet substantially perpendicular to their legs. They then rotate the foot plate about its pivot axis. This causes the foot plate to rise from its original position. The user must move their legs to compensate for this motion, so that they are no longer in the same alignment level with the hips engaging the user support.

In known standing calf machines, the user stands on a stationary support and engages shoulder pads on a rotating arm. They then flex their feet or rise on tip toe while pushing up against the shoulder pads. This can also produce similar problems in keeping the legs in proper alignment with the body and feet. In both cases, it can be difficult for the user to maintain engagement with the foot plate.

SUMMARY

A calf exercise machine in one embodiment has a moving user engagement device and a connecting linkage which translates movement of the user engagement device into rocking movement of the user support.

The calf exercise machine in a first embodiment comprises a seated or rotary calf machine, while a second embodiment comprises a standing calf machine. In one embodiment, a user support is pivotally mounted on a stationary main frame and linked to a moving user engagement device, so that movement of the user engagement device during an exercise is translated into rotation of the user support about its pivot axis. In the first embodiment, the user support comprises a user seat and the user engagement device comprises a pivoted, user engaging foot plate assembly located for engagement by the user's feet when seated on the user support. In the second embodiment, the user support comprises a rotatably mounted foot rest while the user engagement device comprises a pivoted exercise arm having user engaging shoulder pads positioned to engage a user's shoulders while their feet engage the foot rest. In both cases, a connecting linkage translates movement of the user engagement device into movement of the user support.

The combined movement of the user support and user engagement device provides a safer, more natural feeling exercise motion that constantly adjusts the position of the user during the exercise to maintain proper alignment between the parts throughout the exercise. The result is more stability for the exerciser and a more natural feeling exercise movement that more closely replicates the movement found in a corresponding free standing exercise.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 1:
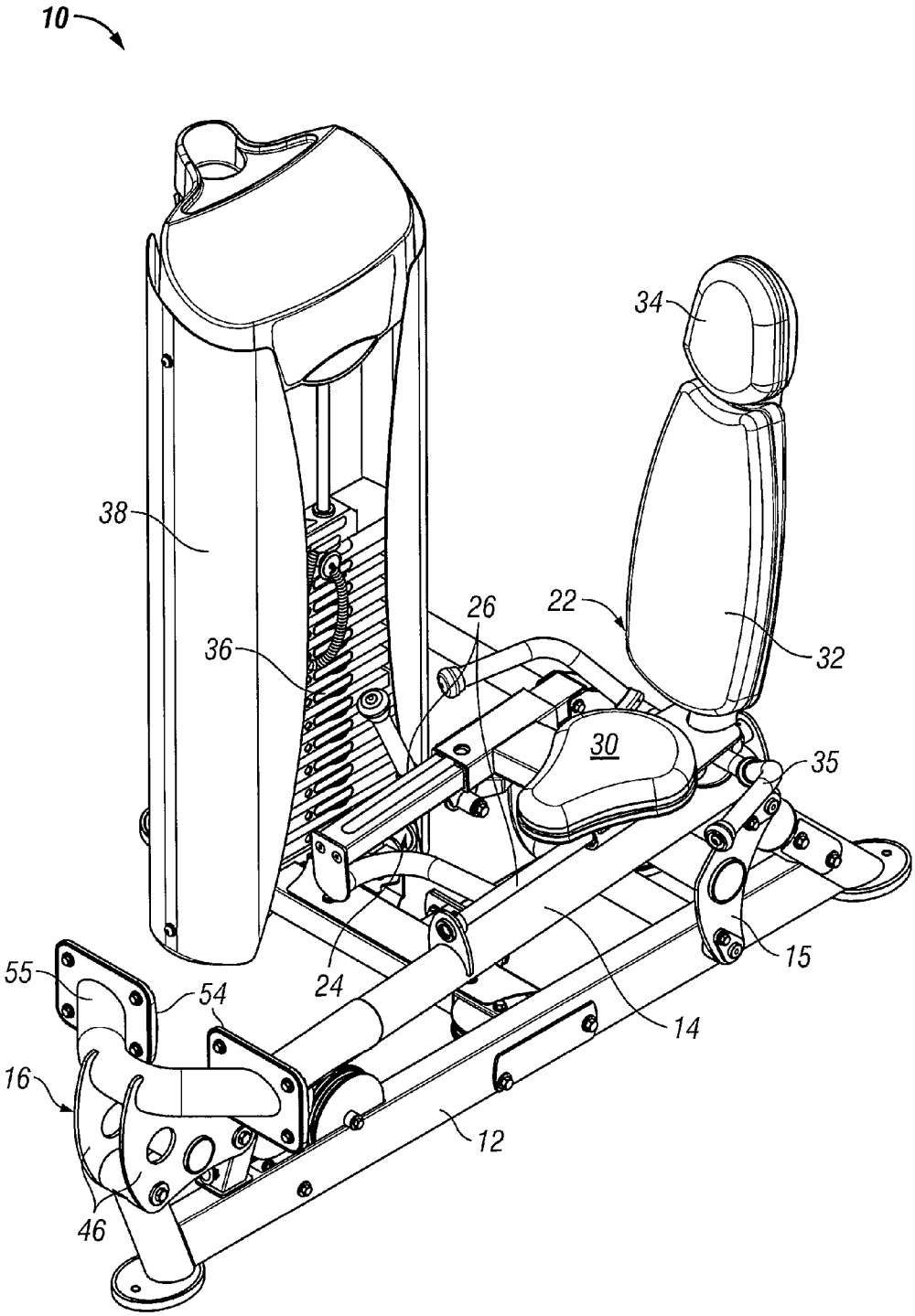
FIG. 1 is a front perspective view of a seated calf exercise machine according to a first embodiment, with the machine in a start position for a calf exercise.

Certain embodiments as disclosed herein provide for a calf exercise machine with a rocking user support. Both the user support and a user engagement device move during an exercise, with a connecting linkage translating movement of the user engagement device to rocking movement of the user support so that the user support tracks the user engagement device to adjust the position of the user relative to the user engagement device during the exercise and provide better stability to the user.

After reading this description it will become apparent to one skilled in the art how to implement the invention in various alternative embodiments and alternative applications. However, although various embodiments of the present invention will be described herein, it is understood that these embodiments are presented by way of example only, and not limitation.

FIGS. 1 to 6 illustrate a first embodiment of a calf exercise machine comprising a seated or rotary calf machine 10, while FIGS. 7 to 13 illustrate a second embodiment comprising a standing calf machine 20. The seated calf machine 10 basically comprises a stationary, floor engaging main frame 12, a user support frame 14 which is pivotally mounted on the main frame at its rear end via connecting link or linkage 15, and a user engaging or exercise arm assembly 16 which is pivotally connected to both the main frame 12 and the forward end of user support frame 15. A user seat 22 is adjustably mounted on the user support frame 14 via a telescopic slide adjuster 24, which allows the position of the seat on the frame to be adjusted for users having different leg lengths. The seat 22 is generally L shaped with a base 25 slidably engaged on rails 26 of adjuster 24 and a rearwardly inclined upright 28. A pull pin release mechanism 29 actuated by handle 31 (see FIGS. 5 and 6) releases the seat to allow it to slide along the rails until the pull pin is re-engaged. A seat pad 30 is mounted on base 25 and a back pad 32 and head rest 34 are mounted on upright 28. Stabilizing handles 35 are mounted on opposite sides of the seat for gripping by a user when performing calf exercises. A stop post 59 projects downwards from the user support frame 14 adjacent its forward end and engages the base of the main frame 12 when the machine is in the start position of FIG. 4, supporting the user seat as a user enters or exits the machine.

Figure 2:
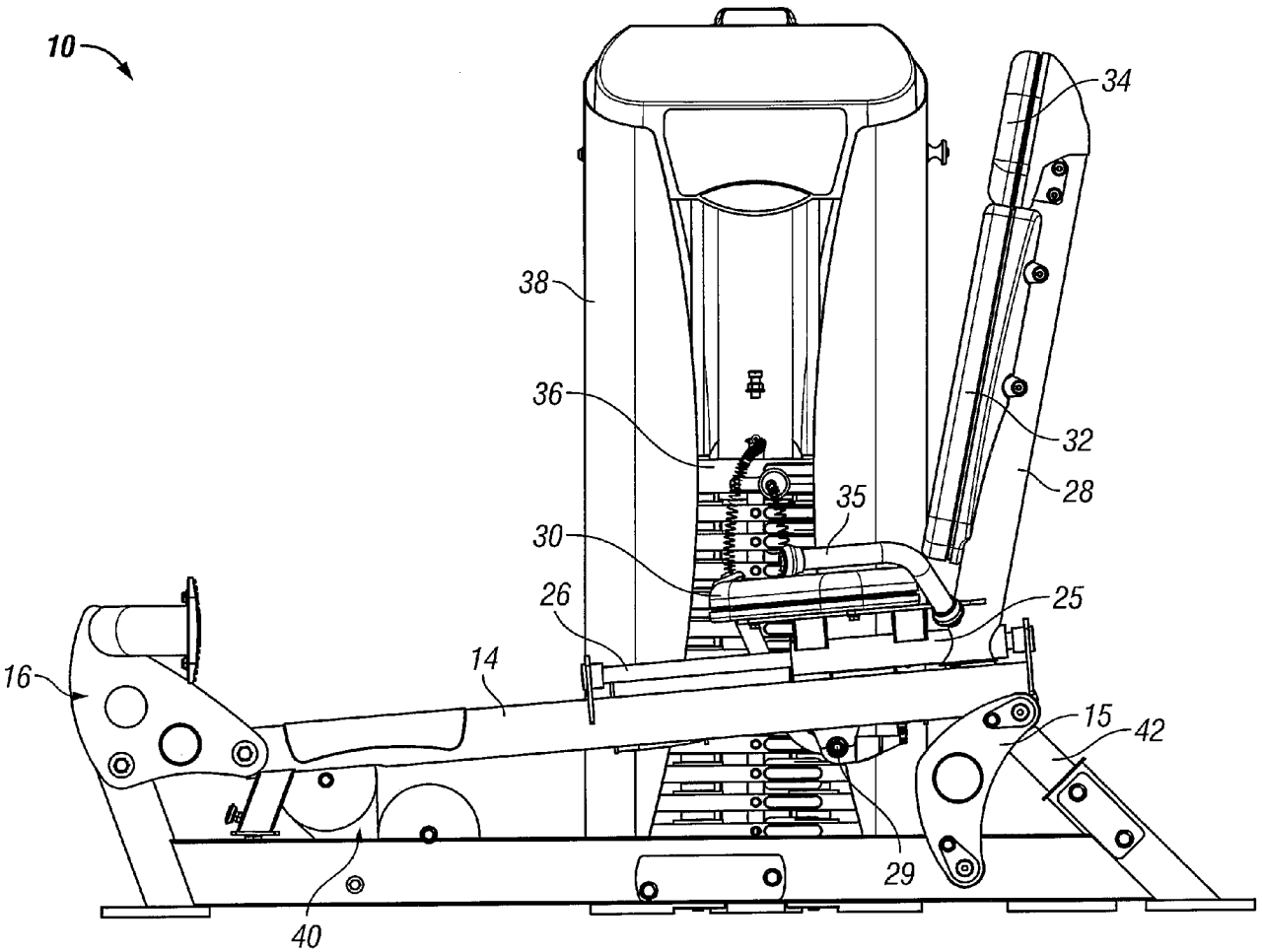
FIG. 2 is a side elevation view of the machine in the start position of FIG. 1.
Figure 3:
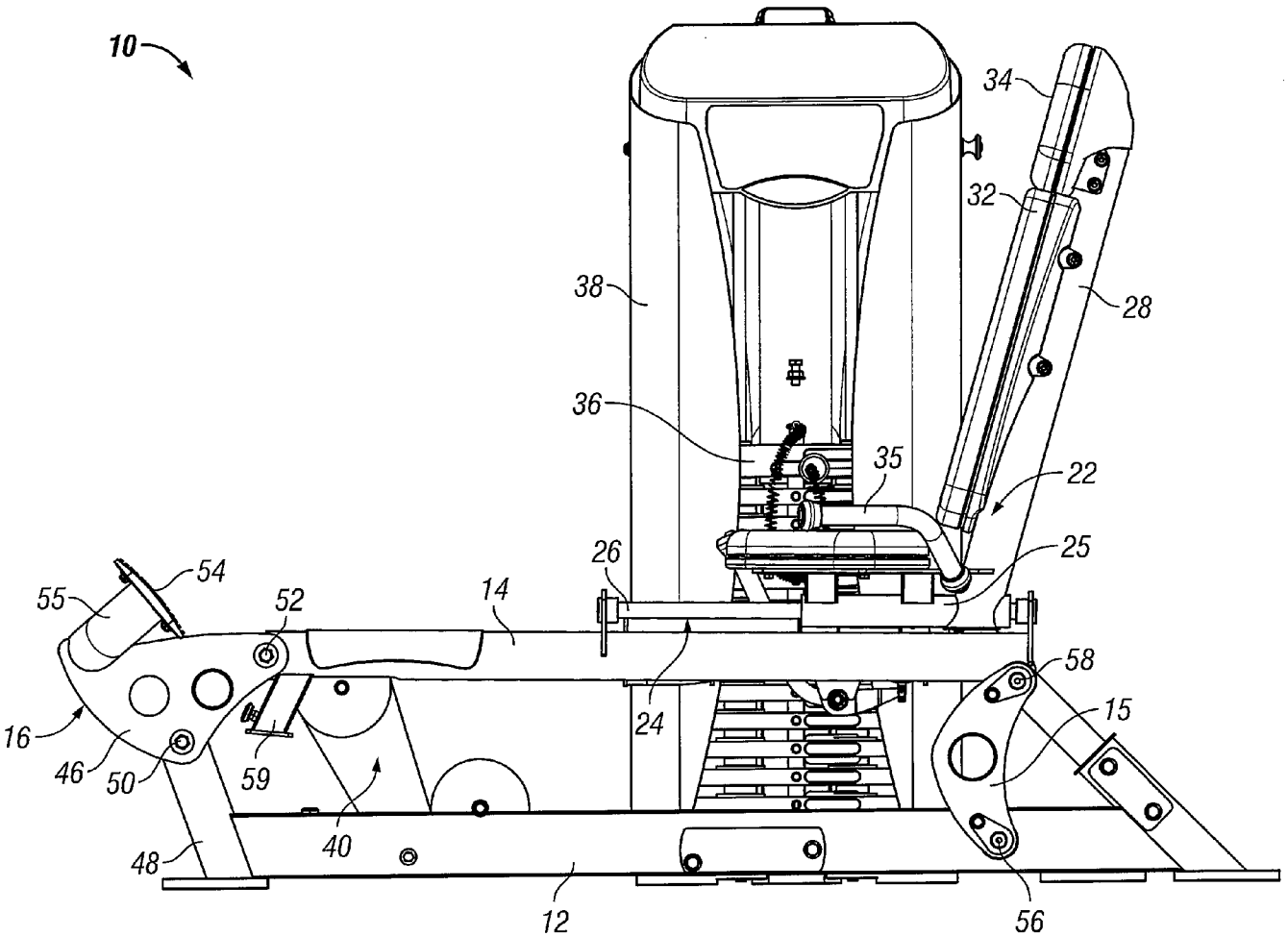
FIG. 3 is a side elevation view similar to FIG. 2 but showing an end position for the calf exercise.
Figure 6:
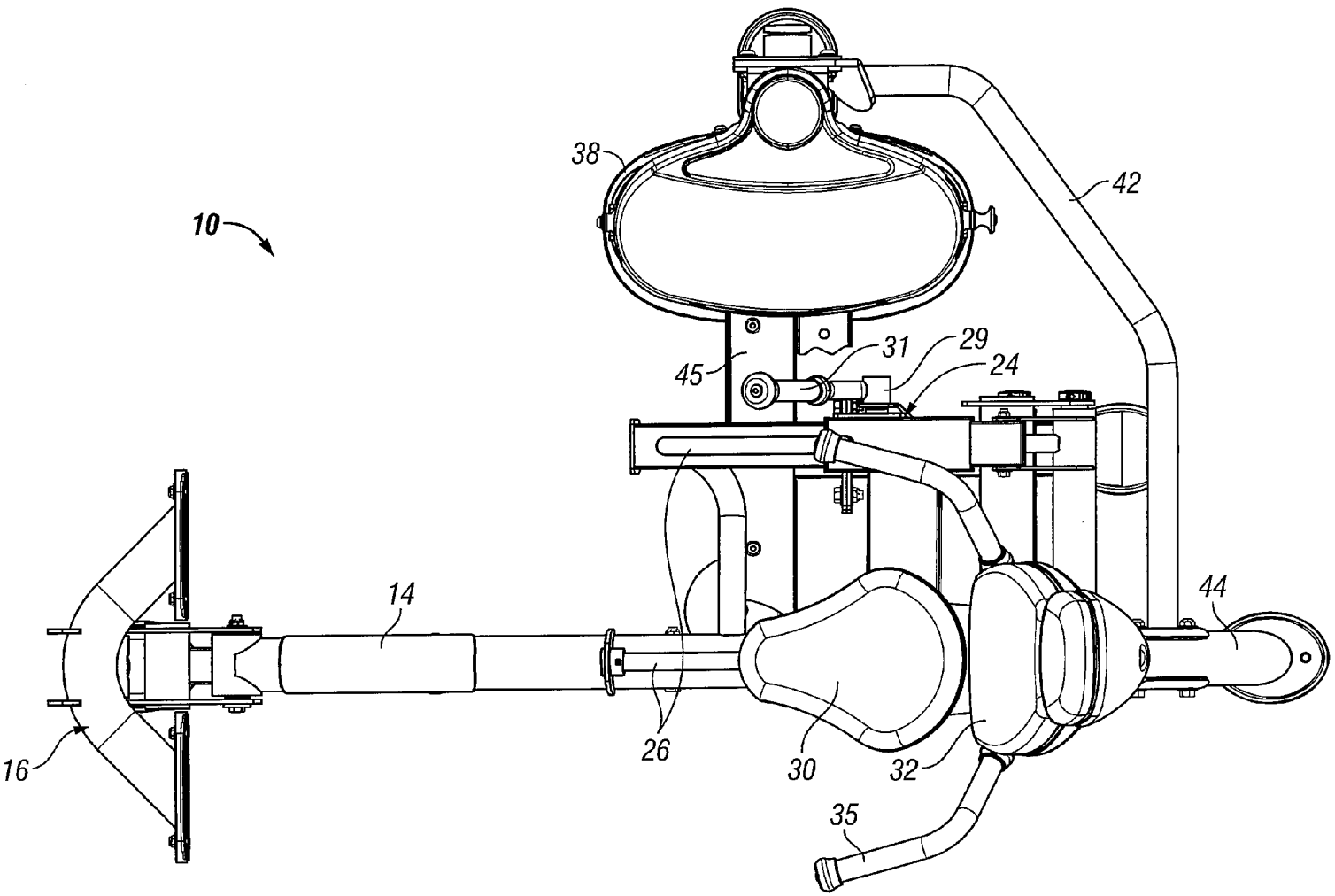
FIG. 6 is a top plan view of the machine of FIGS. 1 to 5.

The user support frame 14 is linked to selected weights in a weight stack 36 in housing 38 via a cable and pulley assembly 40 in a standard manner, so as to provide resistance to rotation of the support frame 14 between the start and end positions of FIGS. 2 and 3. As best illustrated in FIG. 6, the weight stack housing is secured to the main frame via arm 42 which extends between main frame rear strut 44 and the outer side of housing 38, and via a guide tube 45 through which the weight bearing cable extends. The connection between the weight stack housing and main frame may be reversible so that the weight stack can be mounted on either side of the housing.

The exercise arm assembly 16 comprises a pair of generally triangular, pivoted plates 46 which are pivoted at one apex to a front upright post 48 of the main frame via a pivot pin for rotation about a first pivot axis 50, and are pivoted at another apex to a forward end of the user support frame 14 for rotation about a second pivot axis 52. Spaced foot engaging plates 54 are secured via generally U-shaped connecting post or yoke 55 to the third apex of the pivot plates 46, with the yoke 55 welded or otherwise secured to the plates 54 and pivot plates 46. The connecting link or link plate 15 is pivoted at one end to the base of the main frame 12 for rotation about a third pivot axis 56 and at the other end to a rear end of the user support frame 14 for rotation about fourth pivot axis 58. The connecting link 15 and pivoted plates 46 together with the main frame and user support frame form a four bar pivot linkage about which the user support frame pivots relative to the main frame.

In order to use the calf exercise machine 10, the user sits on the seat with the user support frame in the start position of FIGS. 1 and 2, then engages foot plates 54 with their feet generally vertical, placing just the balls of their feet and their toes on the plates 54 with their knees slightly bent. If necessary, the user pulls up handle 31 and slides the seat forwards or rearwards on rails 26 until their feet can comfortably engage foot plates 54 with their knees slightly bent and their low back in contact with the back pad. They then release handle 31 to secure the seat in position, grab the stabilizing handles 35, and pivot their feet at the ankle to press their toes forward, contracting their calf muscles. This simultaneously rotates the foot plates and attached exercise arm assembly forwards and upwards about the pivot axes 50 and 52 and rotates the attached foot plates 54 between the generally upright start position of FIG. 2 and the forwardly inclined end position of FIG. 3. Since the exercise arm assembly is pivotally connected to the stationary main frame and user support frame, this also pulls the user support frame upward, causing connecting link 15 to rotate, which in turn pushes the user support frame forward. This results in a compound movement which reclines the user support position while it moves it forward as the user performs a calf exercise, as can be seen by comparing the solid line user support position 22A with the dotted line position 22B in FIG. 4.

Figure 4:
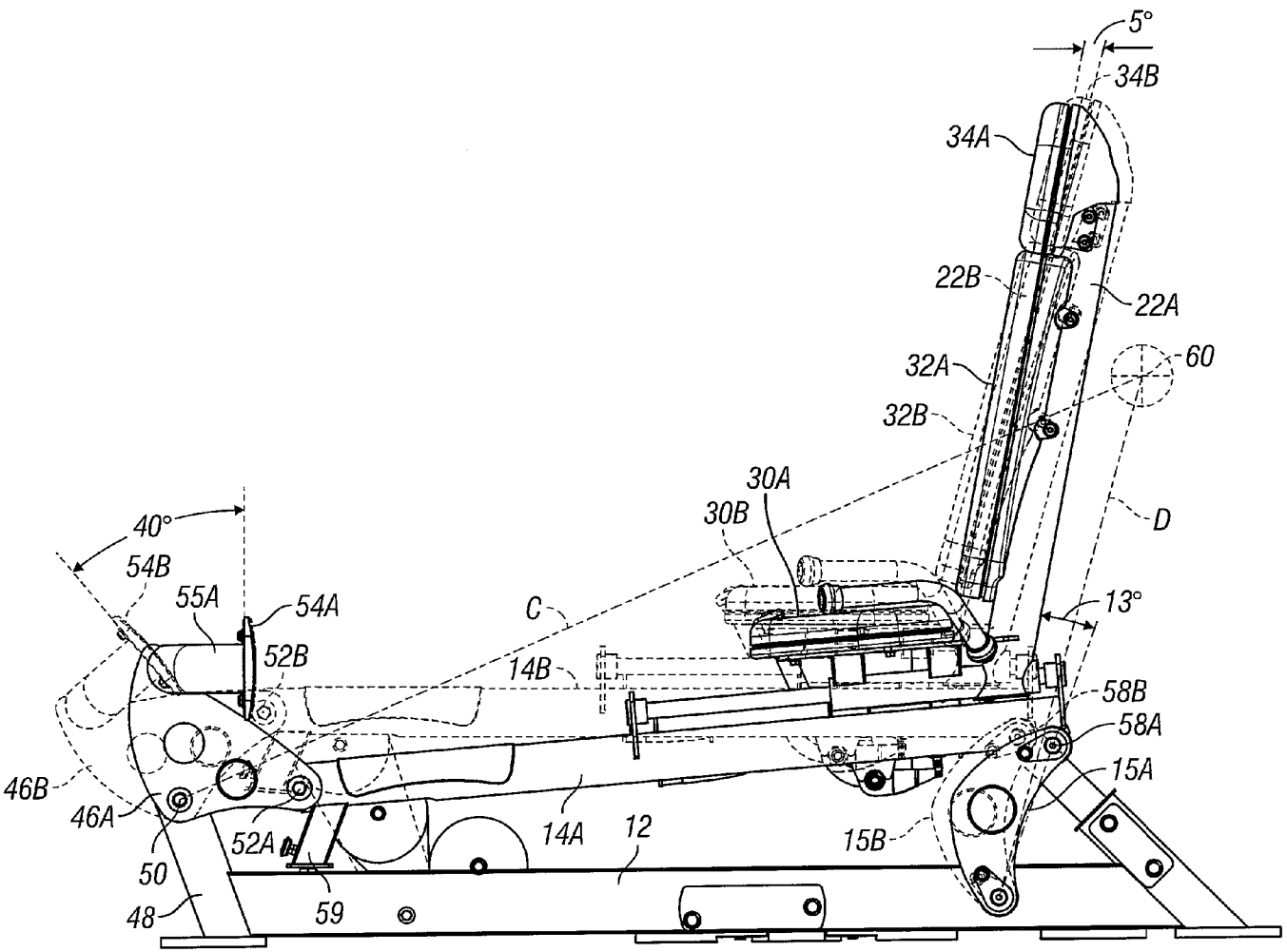
FIG. 4 is a side elevation view showing the two positions of FIGS. 2 and 3 superimposed, to illustrate movement of each moving part of the machine during an exercise, with the weight stack omitted for clarity.
Figure 5:
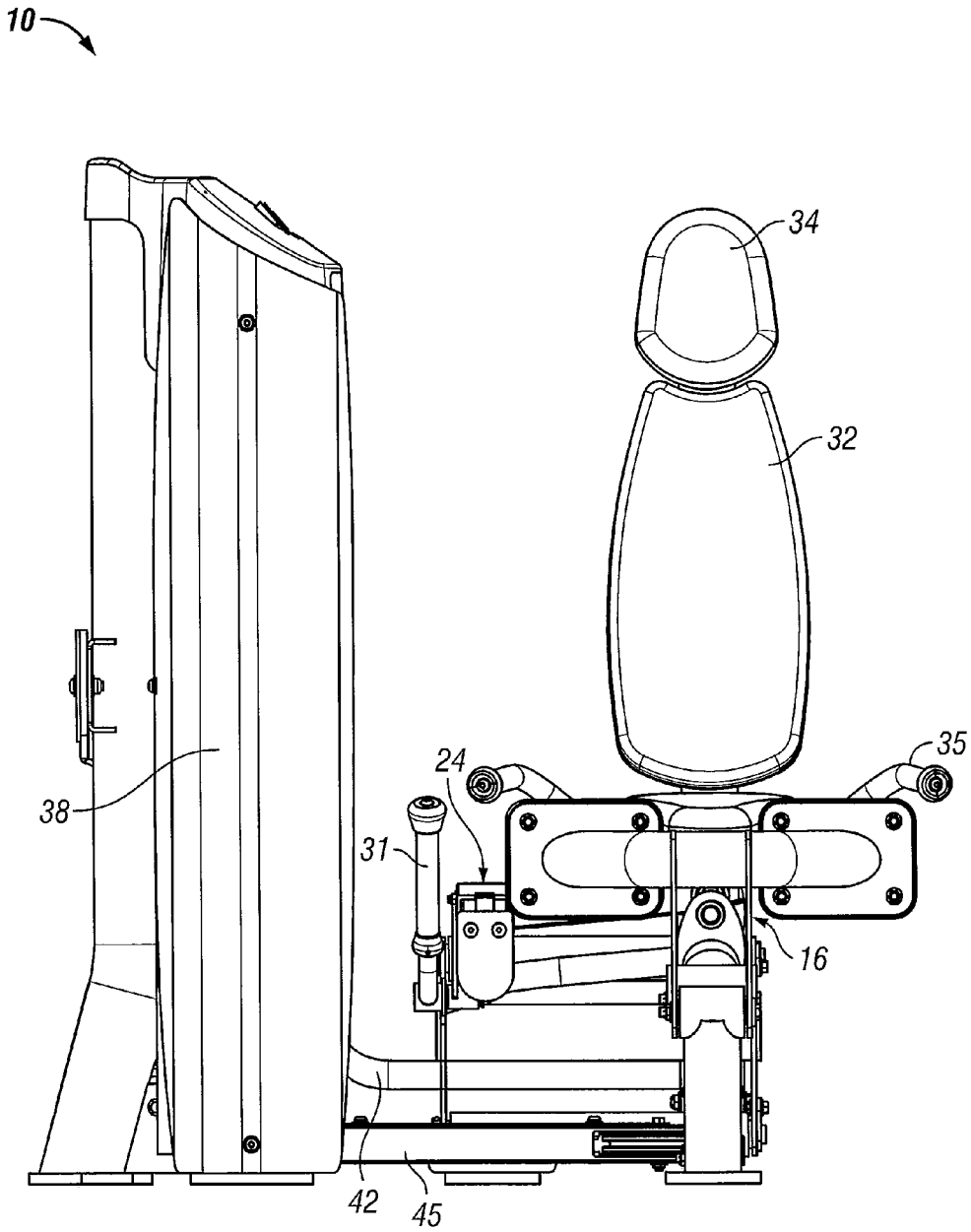
FIG. 5 is a front elevation view of the machine of FIGS. 1 to 4.

In FIG. 4, the start and finish positions of the machine in FIGS. 2 and 3 are overlapped. Part numbers followed by the letter A correspond to the solid line, start position of the calf machine and part numbers followed by the letter B correspond to the dotted line, end position of the calf machine. By using the four-bar linkage including the exercise arm assembly 16 as the user support pivot system, all the pivoting action can take place under the user with the pivot mounts conveniently located on the main frame and user support. However, the theoretical pivot for the user support is actually located elsewhere. The theoretical pivot or virtual pivot of the user support is the point 60 where a single pivot would have to be located in order to mimic the same user support movement shown in FIG. 4.

In order to plot the theoretical pivot point 60, the centerline of the arcing movement for each link of the user support pivot system is calculated. The centerline C of the movement of link plates 46 extends from the center of the line joining the start and finish positions of second pivot axis 52A, 52B through the first pivot axis 50, which is fixed. The centerline D of the movement of link 15 extends from the center of the line joining the start and finish positions 58A, 58B of the fourth pivot axis through the fixed third pivot axis 56. The point in space where the two centerlines C and D intersect is the theoretical or virtual pivot point 60 of the user support.

As illustrated in FIG. 4, the user support frame 14 and user seat 30 are raised as the user pivots foot plates 54 between start position 54A and end position 54B corresponding to a tip toe position, while the entire user support rocks rearwards so that back pad 32 moves into a slightly more reclined orientation 32B. The seat, back pad, and user stabilizing handles are fixed relative to one another so that they move together during the exercise. The base of the user support frame 14 along with the seat pad 30 rotate through an angle of around five degrees between the start position 14A and the end position 14B and the foot plates rotate forwards through an angle of around 40 degrees between start position 54A and end position 54B, as illustrated in FIG. 4. At the same time, the connecting link 15 rotates forward through an angle of around 13 degrees between positions 15A and 15B, and the back rest rotates rearward through an angle of around 5 degrees. The result is a compound movement that reclines the user support position while it moves the support forward. These movements are carefully arranged through the design of the four bar pivot linkage (base of main frame, base of user support, forward pivot links 46 of the exercise arm assembly, rear connecting link 15) such that the user is kept in better alignment throughout the exercise. Lifting of the user support as the foot plates lift and rotate helps the user to keep their legs approximately in a straight line to allow the feet to track the movement of the foot plates which is also controlled by the four bar pivot linkage. This provides a more natural feeling calf exercise which is closer to a free standing calf exercise where an exerciser lifts onto tip toes from a horizontal foot orientation.

In an alternative embodiment of the seated calf machine, the user support may be designed to support a user in an upright seated position. In this alternative arrangement, the user support frame 14 terminates close to the forward end of the seat pad and the user engaging foot plate assembly is located below and close to the forward end of the seat for engagement by the user's feet when they are seated in an upright position with their knees bent at a perpendicular angle.

The standing calf machine 20 of the second embodiment is illustrated in FIGS. 7 to 13. Machine 20 includes a stationary main frame 65, an upper exercise arm assembly 66 pivotally mounted on a main frame upright 68 at an intermediate point in the length of assembly 66, and a foot rest 70 pivotally mounted at the forward end of main frame base 72. A multiple link connecting linkage 74 is provided between the exercise arm assembly and pivoted foot plate, as described in more detail below.

The stationary main frame 65 comprises base 72, rear upright A-frame portion 75 and rear upright 68. Rear upright portion 75 has a pair of upright struts 76 inclined towards one another and connected together by a cross member 78 at their upper ends, and by cross bar 80 at a location spaced below their upper ends, forming a generally A-frame structure. Weight storage pegs 81 are provided on the outside of each upright strut 76. The base is inclined upwardly from the front to the rear end, and secured to horizontal cross bar 80 of the rear upright portion at its rear end. Ground engaging feet 82 are located close to the front end of the base, while a post 87 with an adjustable stabilizing foot 83 is secured to the lower face of base 72 via mounting plate 77 (see FIGS. 7 to 9), extending under cross bar 80 so that the stabilizing foot is located to the rear of the A-frame portion 75. Main frame upright 68 extends from a location between the ends of base strut 72 and is inclined rearwardly to extend between the upright struts 76, and then upwardly to the exercise arm assembly 66.

Figure 7:
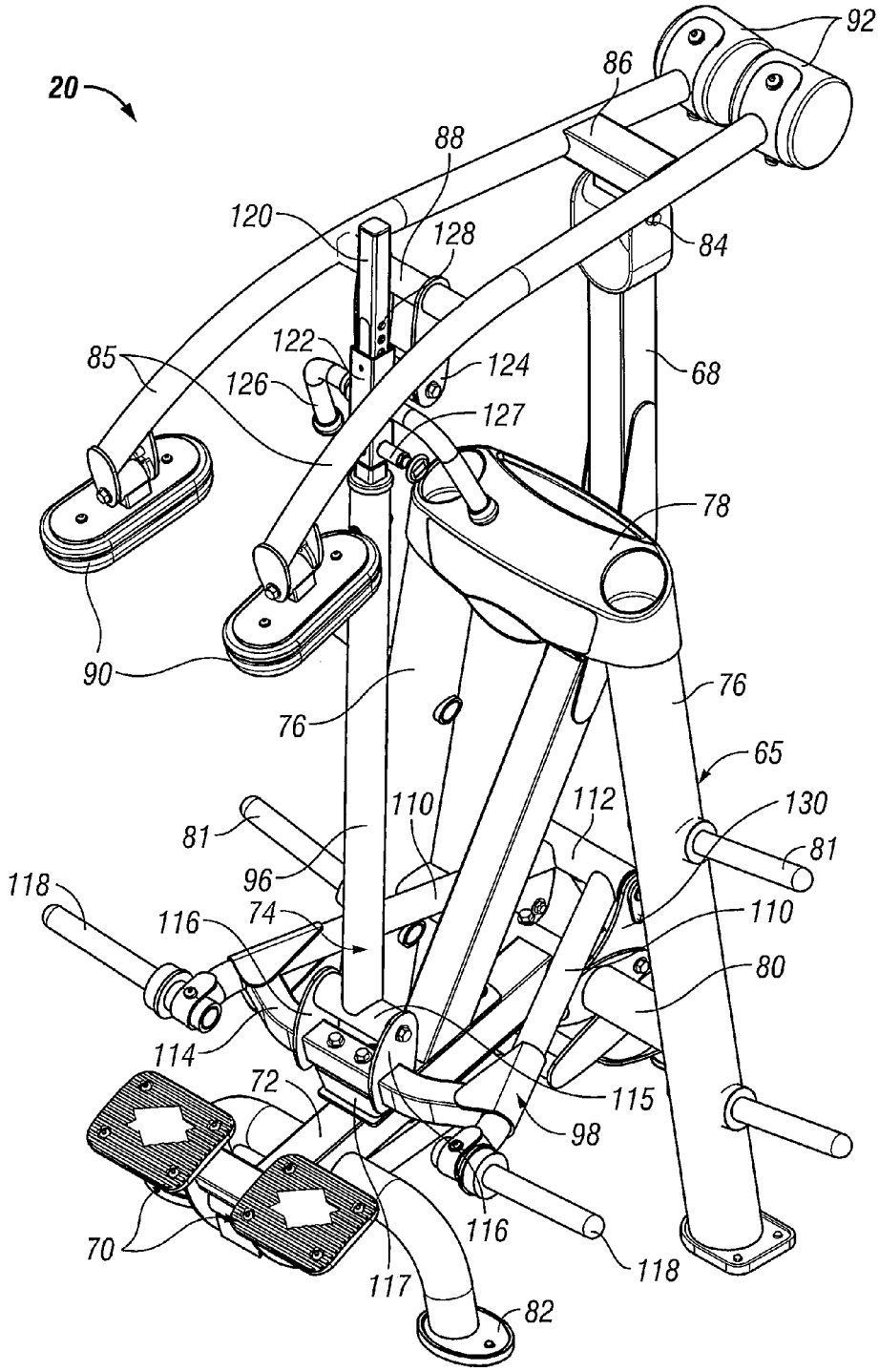
FIG. 7 is a front perspective view of a standing calf exercise machine according to a second embodiment, with the machine in a start position for a calf exercise.
Figure 8:
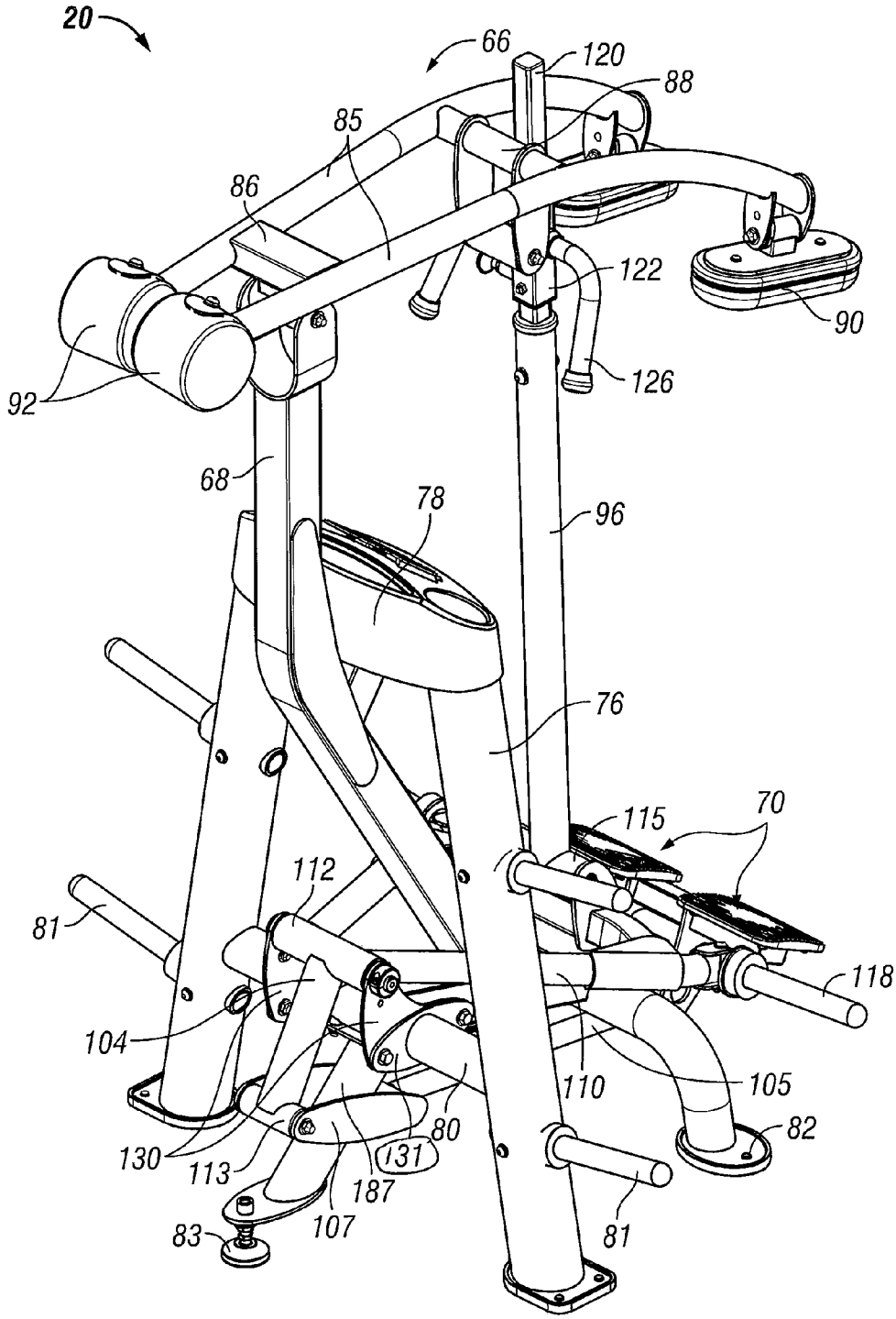
FIG. 8 is a rear perspective view of the machine of FIG. 7
Figure 13:
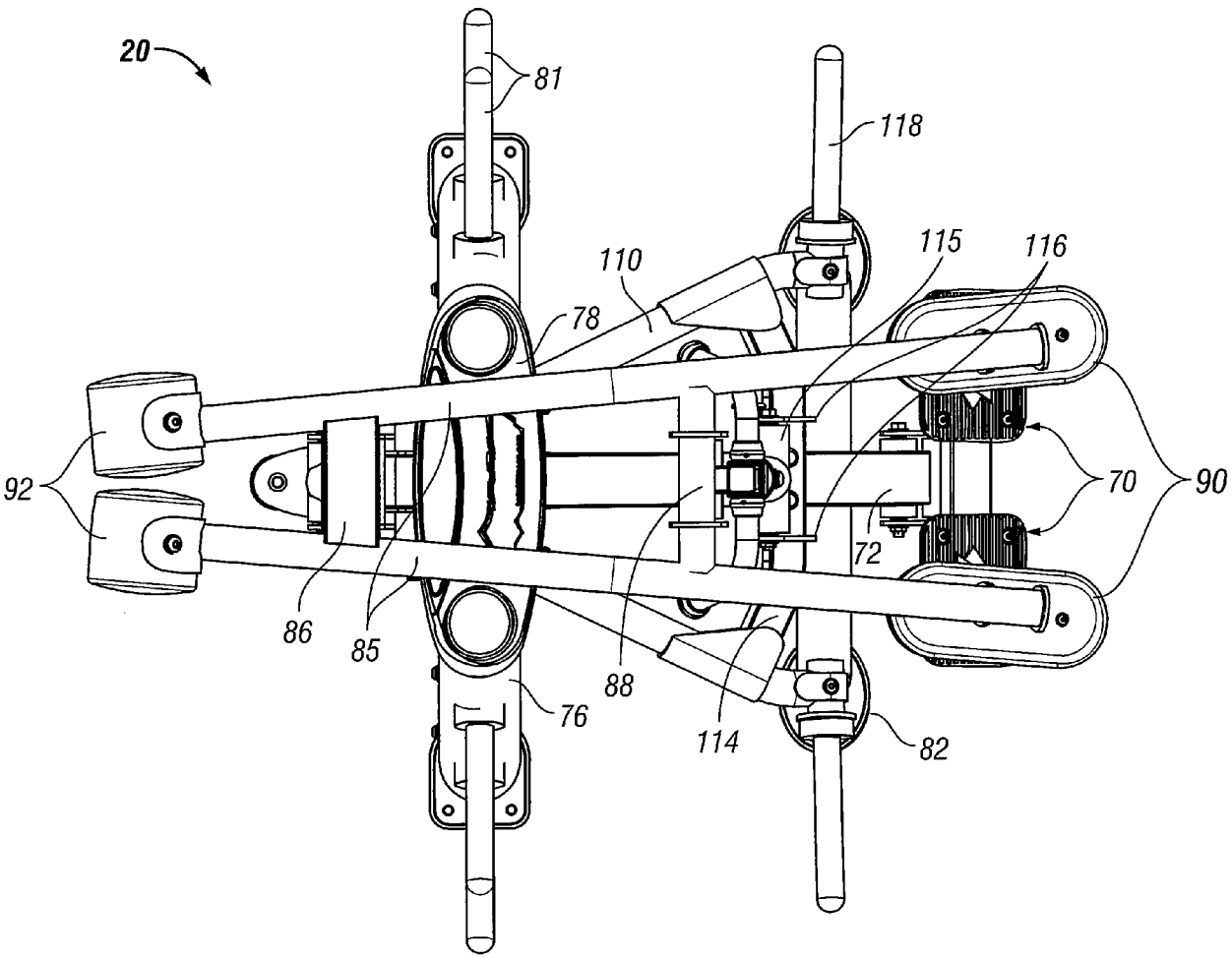
FIG. 13 is a top plan view of the machine of FIGS. 7 to 12.

Exercise arm assembly 66 is pivoted to an upper end of upright 68 for rotation about exercise arm pivot axis 84. As best illustrated in FIGS. 7, 8 and 13, arm assembly 66 comprises a pair of arm members 85 extending across the top of the main frame upright strut 68 and secured together by a pair of spaced cross bars 86, 88, with the pivot connection to upright strut located on cross bar 86. Each arm member 85 has a downwardly facing shoulder pad 90 pivotally secured at its forward end and a counterweight 92 at its rear end.

Foot plate 70 is secured to a pair of downwardly extending pivot brackets or plates 94 which are pivotally mounted at a forward end of the frame base 72 for rotation about foot plate pivot axis 95. The connecting linkage 74 comprises multiple links between exercise arm assembly or user engagement device 66 and the foot plate or user support 70. Connecting linkage 74 includes a first, generally upright connecting link 96 tied to exercise arm assembly 66, and a generally L-shaped lifting arm 98 which is pivoted at a forward end to the lower end of connecting link 96 for rotation about first lift arm pivot axis 100 and pivoted to the main frame upright portion 65 for rotation about second lift arm pivot axis 102. A lift arm tail 104 extends down from pivot axis 102. The final link of the connecting linkage 74 is a drive link 105 which has a rear end pivoted to the lower end of lift arm tail 104 for rotation about third lift arm pivot axis 106 and a forward end pivoted to the lower ends of foot plate pivot plates 94 for rotation about pivot axis 108. The lifting arm 98 is similar to that described in co-pending application Ser. No. 12/253,392, the contents of which are incorporated herein by reference.

Figure 9:
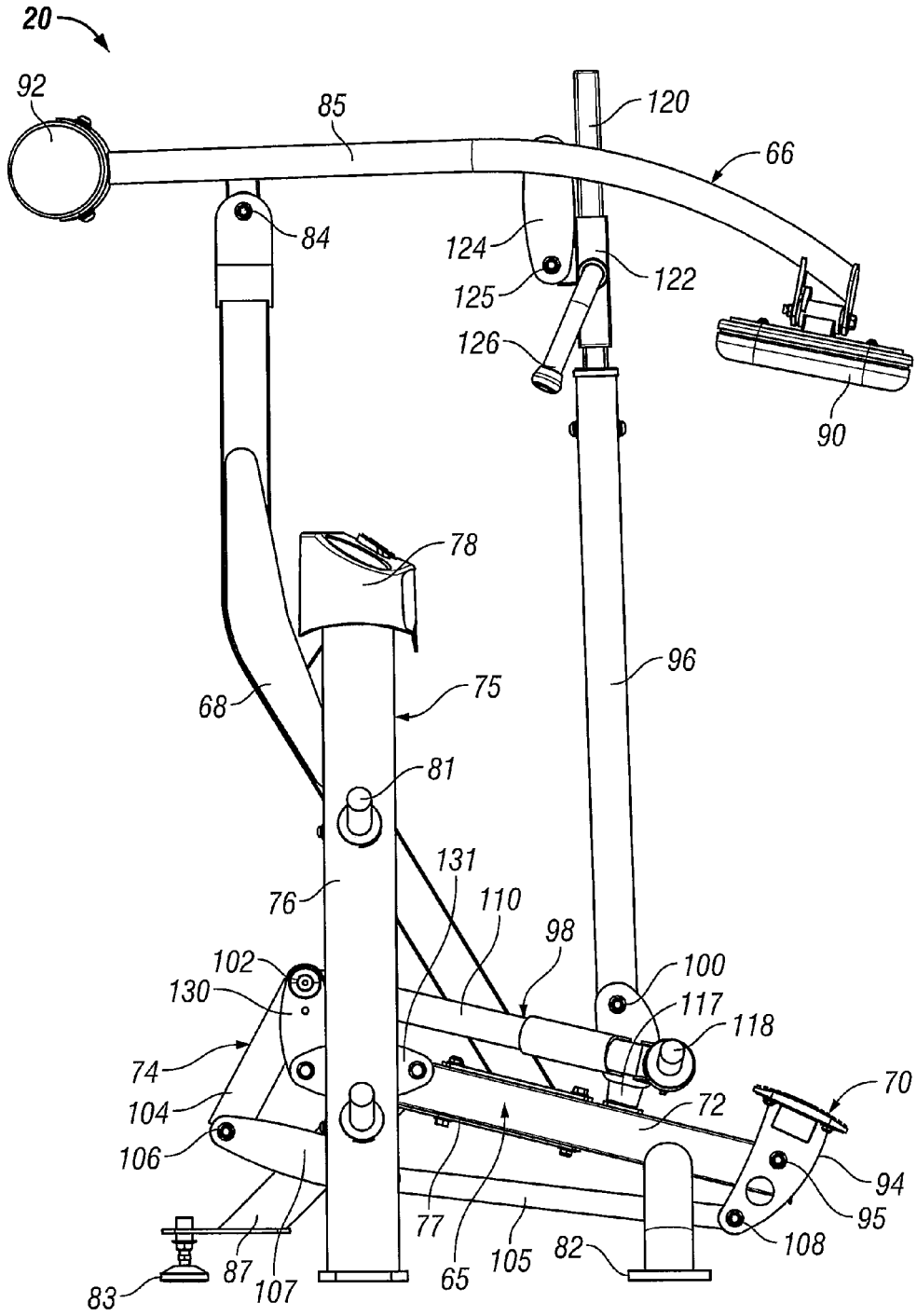
FIG. 9 is a side elevation view of the standing calf machine in the start position of FIG. 7.

As best illustrated in FIGS. 7, 8 and 13, lifting arm 98 has a pair of outwardly diverging rods or bars 110 extending forward from a pivot sleeve 112. Lift arm tail 104 is welded to sleeve 112 to extend downward and rearward in the start position of FIGS. 8 and 9, and pivot sleeve 113 is welded to the lower end of tail 104. Pivot sleeve 113 is rotatably mounted on a pivot pin extending between pivot plates 107 for rotation about pivot axis 106. Pivot plates 107 extend from the end of drive link 105, as best illustrated in FIG. 8. Pivot sleeve 112 is rotatably mounted on a pivot pin extending between pivot brackets 130 for rotation about pivot axis 102, as best illustrated in FIGS. 7 to 9. Pivot brackets 130 are secured to mounting plates 131 on cross bar 80 of main frame portion 65. Rods 110 which extend from sleeve 112 are secured together by a cross bar 114 at a location close to their forward ends, and pivot sleeve 115 at the lower end of connecting link 96 is rotatably engaged over a pivot pin extending between pivot brackets 116 secured to a central portion of cross bar 114, as best illustrated in FIG. 7. A bumper or stop pad 117 extends down from the central portion of cross bar 114 between brackets 116 to engage the main frame base 72 when the machine is in the exercise start position of FIG. 9. A weight plate mounting peg 118 extends outwardly from the forward end of each rod 110.

The upper end of connecting link 96 has an extension rod 120 over which a height adjustment sleeve 122 is telescopically engaged. Pivot bracket or plate 124 extends downward from cross bar 88 of the exercise arm assembly and is pivotally connected to sleeve 122 for rotation about pivot axis 125. The height adjustment sleeve 122 allows the starting position of exercise arm assembly 66 to be adjusted for users of different height, who can grip one of the stabilizing handles 126 secured to adjustment sleeve 122, release spring loaded locking pin 127 with their free hand, and slide the sleeve up or down until the shoulder pads 90 are at the desired height, then release the pin 127 to engage in an aligned opening 128 in extension rod 120. Stabilizing handles 126 are also gripped during an exercise for balance purposes, as discussed below.

Figure 10:
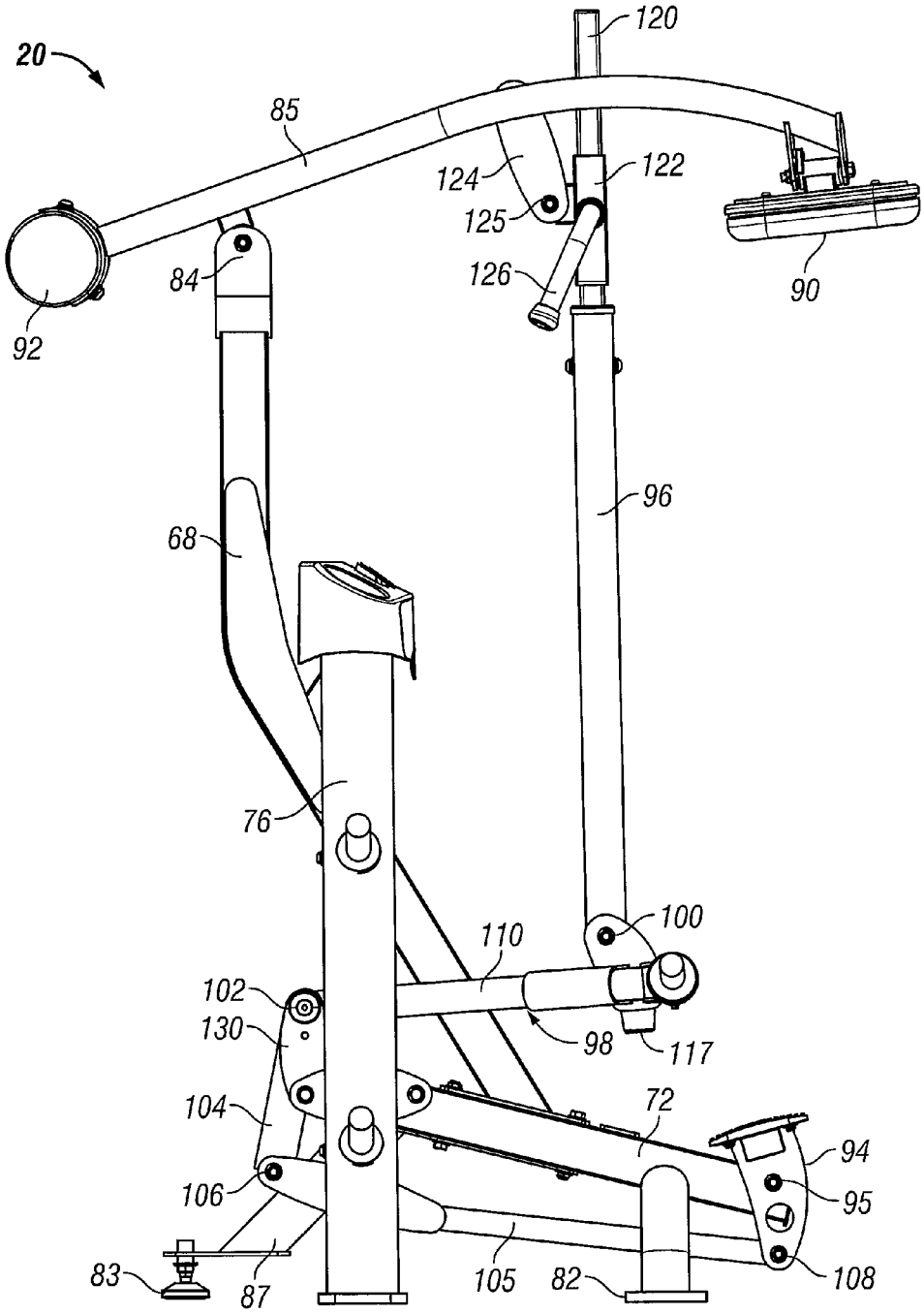
FIG. 10 is a side elevation view similar to FIG. 9 but showing an end position for the calf exercise.

In order to perform a calf exercise using standing calf machine 20, the user stands on the foot rest 70 with the machine in the start position of FIGS. 7 to 9, with their knees slightly bent, placing just the balls of their feet and their toes on the foot rest and letting their heels hang off the end of the foot rest. They then adjust the height of the exercise arm using adjuster sleeve 122 until the shoulder pads 90 rest on their shoulders, and grab the stabilizing handles 126 for balance. The user then rises up on their toes, contracting their calf muscles. This simultaneously pushes up on the shoulder pads 90, rotating forward end portion of the exercise arm assembly 66 upward about pivot axis 84, into a raised position as illustrated in FIG. 10. This end position varies depending on how far the user pivots up on their toes as well as their body dimensions. As the exercise arm assembly 66 is pivoted upward during the calf exercise motion, the connecting link 96, which is pivotally attached to both the exercise arm and the lift arm 98, pulls the forward end of the lift arm upward. This forces the lift arm 98 to pivot about its connection to the main frame at pivot axis 102, in turn rotating the lift arm tail 104 forwards, pushing the drive link 105 forward and causing the foot rest 70 to rotate about pivot axis 95 at its connection to the main frame. Rotation of the foot rest between the position shown in FIG. 8 and that shown in FIG. 9 as the user rises onto their toes helps to keep more of the foot in contact with the foot plate, tracking the foot as it rotates upward at the heel. This in turn allows the user to put more force into the lift and also makes them feel more stable. Weights can be added to weight pegs 118 to vary the exercise resistance.

Figure 11:
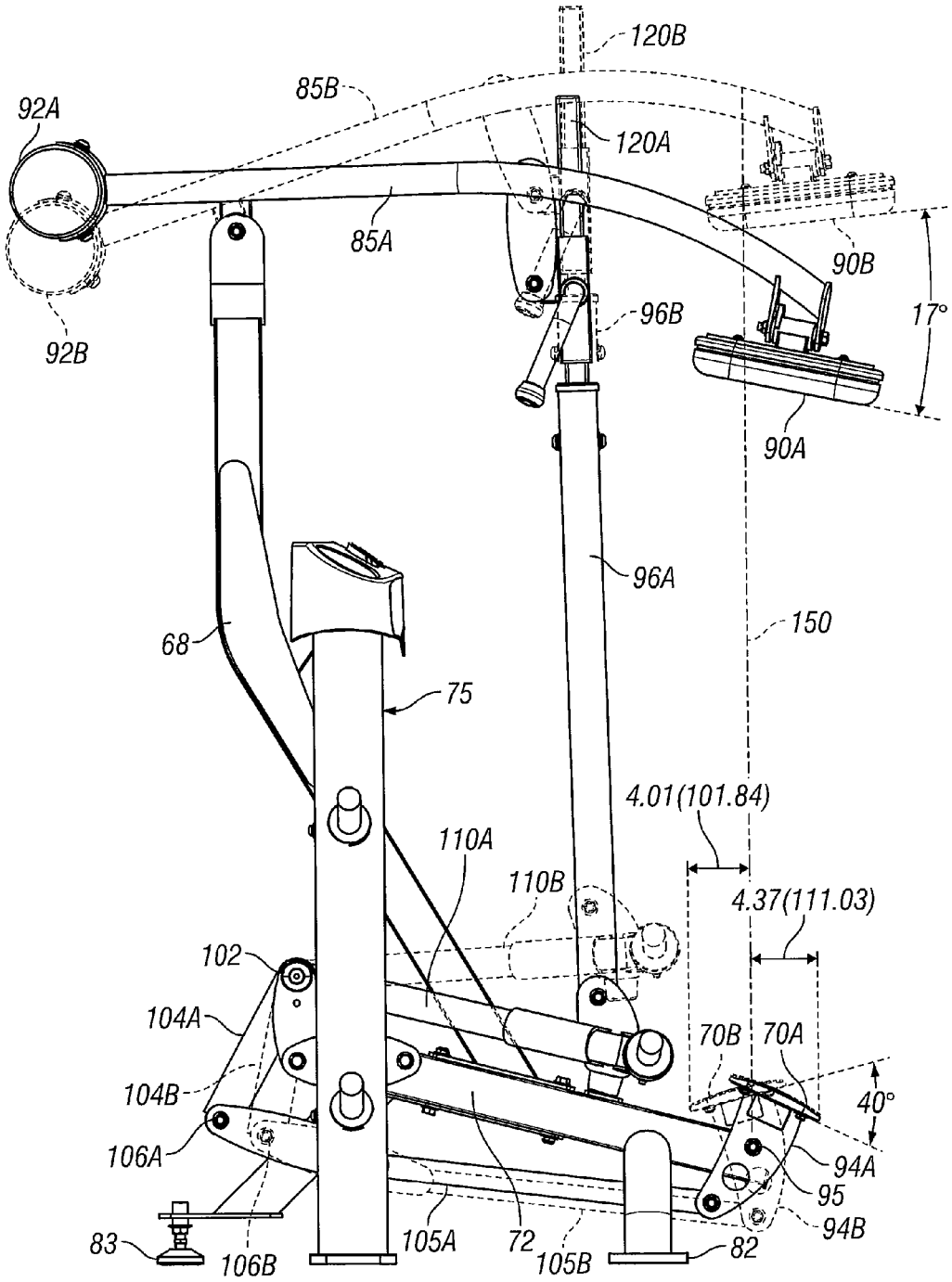
FIG. 11 is a side elevation view showing the two positions of FIGS. 9 and 10 superimposed, to illustrate the movements of the moving parts of the machine during an exercise.
Figure 12:
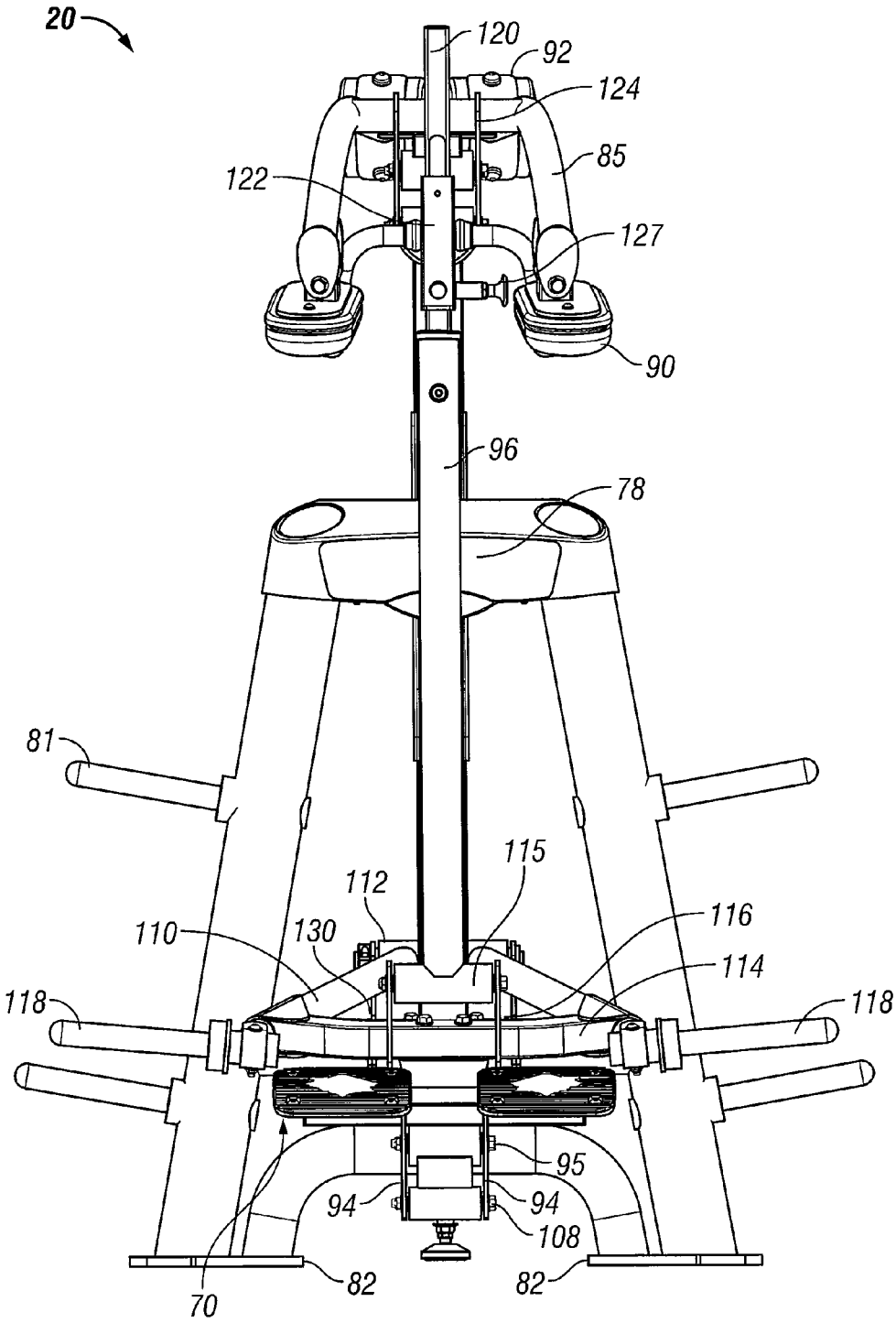
FIG. 12 is a front elevation view of the machine of FIGS. 7 to 11.

In FIG. 11, the start and finish positions of the machine in FIGS. 9 and 10 are overlapped. Part numbers followed by the letter A correspond to the solid line, start position of the calf machine and part numbers followed by the letter B correspond to the dotted line, end position of the calf machine shown in FIG. 10. This illustrates the linked relationship of the movements of the exercise arm assembly 66, connecting linkage 74 including the lift arm, and the pivoted foot rest 70. As the exercise arm is pushed up by the user lifting onto their toes between the start position 85A and an end position 85B, connecting link 96 also moves upward between the solid line and dotted line positions 96A and 96B, as shown. The lift arm rods rotate upwardly about pivot axis 102 between position 110A and 110B, simultaneously rotating the lift arm tail 104 about the same pivot axis between positions 104A and 104B. This pushes the drive link forward and slightly downward into dotted line position 105B, and rotates the foot plate rearward about pivot axis 95 into position 70B. As illustrated, the arrangement and dimensions of the various pivot links are such that rotation of the exercise arm through around 17 degrees simultaneously rotates the foot plate 70 through 40 degrees and moves it from a position 70A in which the front edge is located around 4.37 inches in front of the gravitational center line 150 extending through pivot axis 95 and a position 70B in which the rear edge of plate 70 is located around 4.01 inches behind center line 150. In other words, the majority of the foot plate is in front of the gravitational center line in the start position, and the majority of the plate is rear of the center line in the end position. This helps to keep the exercise resistance more uniform throughout the movement and reduce resistance drop off.

In each of the above embodiments, movement of a user engagement device is translated into rocking movement of a user support, making the exercise more enjoyable for the user. Additionally, the linked relationship between the movement of the user engagement device or exercise arm and the movement of the user support in the above embodiments is designed so that movement of the user support tracks movement of the user engagement device and keeps the user in better alignment for engaging the user engagement device. In the embodiment of FIGS. 1 to 6, the user support is the seat and back rest, while in FIGS. 7 to 13 it is the foot plate 70. The user engagement device or exercise arm in FIGS. 1 to 6 is the foot plate, while in FIGS. 7 to 13 it is the exercise arm assembly 66 on which the shoulder pads are mounted. The purpose of linking the user engagement device and user support movement is to maintain a predetermined relationship between the supported part of the user on the user support and their engagement position on the user engagement device throughout the entire exercise movement. Another purpose is to provide a safer exercise movement where the position of the user support adjusts to the position of the user engagement device and provides support based on that position, so that the user feels more stable while they are performing calf exercises. The arrangement is such that the foot plate movement tracks the movement of the user's feet when extending onto their toes to exercise the calf muscles. A further purpose is to provide a more comfortable, better feeling exercise that enhances the user's workout.

It should be understood that all the different elements used in the two embodiments may be mixed and interchanged with one another and still incorporate the essence of the above embodiments. The exercise arms could be one piece (dependent) or two-piece (independent), and could have rotational or linear movement, and may be mounted on the main frame, user support or connecting link. The connecting links could be made adjustable and could push or pull to urge rotation of the user support which can be made to rotate forward or rearward. Either of the embodiments could have the resistance associated with any of the moving parts (user support, exercise arm or connecting link).

It should also be noted that different types and forms of components could be used in the above embodiments. Cables could be replaced with belts, ropes, chains or the like, pulleys replaced with sprockets, and tubes could be replaced with solid rods or bars. The seat, back pad, and/or foot plate may be made adjustable. Other types of resistance known to the art could by used for providing exercise resistance, such as hydraulic, pneumatic, electro-magnetic or elastic band resistance devices.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

We claim:

1. A calf exercise machine, comprising:

a stationary main frame having a forward end and a rear end;

a user support assembly pivotally mounted relative to the main frame and adapted to support a user in an exercise position, the user support assembly being movable between a start position and an end position during a calf exercise, the user support assembly comprising a foot plate assembly which has at least one pivotally mounted foot plate adapted for engagement by a user's feet when performing a calf exercise to support a user in a standing position facing rearward, and rotatable during a calf exercise to accommodate rotation of a user's feet about the ankle joints to contract the calf muscles;

an exercise arm assembly movably mounted relative to the main frame, the exercise arm assembly having shoulder pads adapted for engagement by a user's shoulders when standing on said at least one foot plate;

a connecting linkage between the user support assembly and exercise arm assembly which links movement of one of the assemblies to movement of the other assembly; and a load which resists movement of at least one of the exercise arm assembly, the foot plate assembly, and the connecting linkage.

2. The apparatus of claim 1, further comprising at least one lifting arm movably mounted relative to the main frame and associated with at least one of the foot plate assembly, exercise arm assembly, and connecting linkage.

3. The apparatus of claim 2, wherein the connecting linkage comprises at least one connecting link pivotally connected between the exercise arm assembly and the lifting arm, whereby the lifting arm is moved in response to movement of the exercise arm assembly during a calf exercise.

4. The apparatus of claim 3, wherein the lifting arm is pivotally connected to said at least one foot plate, whereby the foot plate is rotated in response to movement of the lifting arm.

5. The apparatus of claim 1, wherein the load is mounted on the lifting arm.

6. The apparatus of claim 5, wherein the lifting arm has at least one weight peg and the load comprises one or more weights mounted on said at least one weight peg.

7. The apparatus of claim 3, further comprising a pivot mount on the main frame which pivotally connects the lifting arm to the main frame.

8. The apparatus of claim 7, wherein the connecting link is linked to the lifting arm at a location spaced forward from the pivot mount.

9. The apparatus of claim 8, wherein said at least one foot plate is linked to the lifting arm at a location spaced rearward from the connecting link.

10. The apparatus of claim 9, wherein the lifting arm has a forward end and a rear end, and a drive link is pivotally connected between the rear end of the lifting arm and said at least one foot plate.

11. The apparatus of claim 8, wherein said at least one foot plate comprises two spaced foot plates which are connected together to move in unison during a calf exercise.

12. The apparatus of claim 1, wherein the exercise arm assembly has a forward end and a rear end, the main frame has a generally upright strut and the exercise arm assembly is pivotally connected to the upright strut at first location spaced between the ends of the exercise arm assembly, and the shoulder pads are mounted adjacent the forward end of the exercise arm assembly.

13. The apparatus of claim 12, further comprising at least one counterweight at the rear end of the exercise arm assembly.

14. The apparatus of claim 12, further comprising at least one lifting arm movably mounted relative to the main frame, the connecting linkage comprising a connecting link extending between the lifting arm and exercise arm assembly and pivotally linked to said at least one exercise arm at a second location spaced between said first location and said shoulder pads.

15. The apparatus of claim 14, wherein the connecting link has a lower end pivotally linked to the lifting arm.

16. The apparatus of claim 1, wherein the foot plate assembly is pivotally mounted on the main frame for rotation about a foot plate pivot axis, and said at least one foot plate is adapted to rotate between a forward inclined and a rearward inclined orientation during a calf exercise.

17. The apparatus of claim 16, wherein at least a major part of the at least one foot plate is located in front of a vertical gravitational center line extending through the foot plate pivot axis in a start position of a calf exercise and a major part of the at least one foot plate is located to the rear of the vertical gravitational center line at the end of a calf exercise.

18. The machine of claim 1, wherein the main frame has a floor engaging base portion and the foot plate assembly is pivotally mounted on the base portion of the main frame.

19. A calf exercise machine, comprising:

a stationary main frame;

a user support adapted to support a user in an exercise position and pivotally mounted relative to the main frame for rotation between a start position and an end position during a calf exercise;

at least one user engagement device movably mounted relative to the main frame which is engaged by the user in performing exercises;

one of the user support and user engagement device comprising a foot plate assembly adapted for engagement by a user's feet when performing a calf exercise and rotatable during a calf exercise to accommodate rotation of a user's feet about the ankle joints to contract the calf muscles;

a connecting linkage which translates movement of the user engagement device to movement of the user support;

at least one lifting arm movably mounted relative to the main frame and associated with at least one of the user support, user engagement device, and connecting linkage, whereby the lifting arm moves in response to movement of at least one of the user support, user engagement device, and connecting linkage; and a load which resists movement of the lifting arm.

20. The machine of claim 19, wherein the user support comprises the foot plate assembly and the user engagement device comprises an exercise arm assembly pivotally mounted on the main frame above the foot plate assembly.

21. The machine of claim 20, wherein the foot plate assembly has at least one pivotally mounted foot plate adapted to support a user in a standing position, and the exercise arm assembly has shoulder pads adapted for engagement by a user's shoulders when standing on said at least one foot plate.

22. The machine of claim 21, wherein the exercise arm assembly has a forward end and a rear end and is pivotally mounted on the main frame at a first location spaced between said ends, the shoulder pads are spaced forward from said first location, and at least one counterweight is mounted on the exercise arm assembly at a location spaced rearward from said first location.

23. The machine of claim 19, wherein the connecting linkage comprises a multiple part connecting linkage between said foot plate assembly and said user engagement device, and the lifting arm comprises part of said connecting linkage.

24. The machine of claim 23, wherein the lifting arm has a first portion and a second portion connected together at an angle to form a substantially L-shaped configuration, and the connecting linkage comprises at least one first link between the user engagement device and the first portion of the lifting arm and at least one second link between the second portion of the lifting arm and the user support.

25. The machine of claim 24, wherein the first link is pivotally connected to the first portion of the lifting arm at a first lift arm pivot axis, the lifting arm is pivotally connected to the frame at a second lift arm pivot axis spaced from the first lift arm pivot axis, and the second link is pivotally connected to the lifting arm at a third lift arm pivot axis spaced from the first and second lift arm pivot axes.

26. The machine of claim 25, wherein the first link is pivotally connected to the user engagement device at a location spaced above the lifting arm, and the user support is pivotally connected to the second link at a location spaced forward from at least the second and third link arm pivot axes.

27. The machine of claim 19, wherein the foot plate assembly is pivotally connected to the main frame for rotation about a first foot plate pivot axis, and is movably associated with the lifting arm at a location spaced from the first foot plate pivot axis.

28. The machine of claim 19, wherein the lifting arm has at least one weight peg for receiving at least one weight.

29. The machine of claim 28, wherein the lifting arm has a pair of rods pivotally mounted on the frame, each rod having an outwardly directed weight peg for receiving one or more selected weights.

30. The machine of claim 19, wherein the main frame has a forward end and a rear end, the foot plate assembly is located adjacent the forward end of the machine and comprises at least one foot plate adapted to support a user in a standing position facing the rear end of the main frame, and the connecting linkage is configured to rotate the foot plate from a forwardly inclined orientation to a rearwardly inclined orientation during a calf exercise.

* * * * *